US006126542A

United States Patent [19]

Fier

[11] Patent Number: 6,126,542

[45] Date of Patent: Oct. 3, 2000

[54] GAMING DEVICE AND METHOD OFFERING PRIMARY AND SECONDARY GAMES

[75] Inventor: Robert B. Fier, Las Vegas, Nev.

[73] Assignee: Boyd Gaming Corporation, Las Vegas, Nev.

[21] Appl. No.: 08/909,301

[22] Filed: Aug. 11, 1997

[51] Int. Cl.[7] ..... A63F 9/24

[52] U.S. Cl. ..... 463/16; 463/25; 273/138.2

[58] Field of Search ..... 463/20, 19, 18, 463/17, 16, 15, 14, 13, 12, 11, 10, 9; 273/143 R, 138.2, 139, 292, 293

[56] References Cited

U.S. PATENT DOCUMENTS

| | | | |
|---|---|---|---|
| 4,756,531 | 7/1988 | DiRe et al. | 273/143 R |
| 4,871,171 | 10/1989 | Rivero | 463/16 |
| 5,393,057 | 2/1995 | Marnell, II | 463/13 |
| 5,513,846 | 5/1996 | Niederlein et al. | 273/143 R |
| 5,560,603 | 10/1996 | Seelig et al. | 273/143 R |
| 5,833,537 | 11/1998 | Barrie | 463/16 |

FOREIGN PATENT DOCUMENTS 2147773 5/1985 United Kingdom .

*Primary Examiner*—Valencia Martin-Wallace
*Assistant Examiner*—Mark A. Sager
*Attorney, Agent, or Firm*—Quirk & Tratos

[57] ABSTRACT

A gaming device and method for offering a primary and secondary game is set forth. The primary game may be a video poker game. When the player obtains a predetermined outcome in the primary game such as a flush, the player receives a reward and the secondary game is initiated wherein the player is presented with a field of game choice symbols representing hidden values. The player selects symbols which reveal the selected hidden values. If the revealed hidden values correspond to a secondary winning outcome, the player receives an additional reward.

2 Claims, 4 Drawing Sheets

GAMING DEVICE AND METHOD OFFERING PRIMARY AND SECONDARY GAMES

FIELD OF THE INVENTION

The present invention relates to electronic and electromechanical gaming devices and methods. More particularly, it relates to games presenting both a primary and secondary game.

BACKGROUND OF THE INVENTION

The gaming industry is perhaps one of the most fertile areas for game innovation in an attempt to continue to stimulate players to encourage them to play. While creativity is quite high, the attrition rate for games can also be high if the game is not accepted by consumers. It has also been found that by providing a game which offers large jackpots, play can also be stimulated.

One strategy in maintaining consumer interest is to stimulate play by offering large, progressively accumulated awards. Progressive type machines are example of such two tiered systems where the players are encouraged to achieve an extraordinary payout while playing a primary game. It has been observed that after the extraordinary payout occurs, participation in the underlying game decreases abruptly.

Marnell II, U.S. Pat. No. 5,393,057 shows use of a video poker game or reel-type slot machine for the primary game and a bingo type game as a secondary game. Certain outcomes from the primary game are reflected in the second game bingo card and, upon the occurrence of obtaining outcomes from the first game which are reflected in the second game in a predetermined pattern resulting in a bingo, a secondary award is made to one or more players responsible for obtaining the bingo.

Another game presently used includes a primary game, such as a presentation of a multiple reel-type slot machine. A player makes a wager to play the primary game. If the player obtains one or more designated symbols on the pay line for the machine, a secondary reel is activated which selects the award to the player. In these games, the outcomes of the primary and second games are, basically, randomly selected. The player is offered no semblance of an opportunity to effect the outcome of the second game.

In another game which has heretofore been provided, an electronic game is provided wherein the primary game is video poker. The player makes a wager and initiates play of the primary game whereupon representations of five playing cards are displayed at the game display. The player can select none, one or all of the cards to save. Once the selection has been made, the player draws whereupon the processor for the device replaces any discarded cards with replacement cards to define an outcome for the primary game. The outcome obtained in the primary game is sensed and compared to stored data representing winning primary game outcomes. If no winning outcome is sensed, the player's wager is lost and retained by the machine. If the outcome matches one of the primary game winning outcomes, the player is rewarded according to an established pay table. When a winning outcome is obtained, the machine offers the player an opportunity to double their reward by optionally participating in a secondary game. If the player opts to participate, the processor selects from a data registry containing data representing each card of a deck of 52 cards, data representing five cards. The selected cards are displayed as one card face up, denoted as the dealer's card, and four cards face down. The player must select one of the face down cards, the player's card, which he believes when revealed will outrank the dealer's card. By using selection buttons the player makes the selection whereupon the processor is prompted to reveal the value of the selected card and compares it to the dealer's card. If the player's card outranks the dealer's card, the player's initial reward is doubled. If it is a tie ranking, there is no action and the primary game reward is neither lost nor doubled. If the player's card is of a lesser ranking, the primary game reward is forfeited.

The above games suffer from several drawbacks. One is that these games cannot offer, for the secondary game, large jackpots. Further, there is no feature of giving the player selection opportunities in the second game. Thus, the player cannot feel that they can control their destiny by making correct or "lucky" selections. Further, in many of these games the player must risk the reward from the primary game to participate. If they lose the secondary game, they lose their reward obtained from the primary game. What is needed is a device and method which provides for play of a primary game during which the player has presented, from time to time, a secondary game offering the player the chance to obtain a high, secondary reward, offering the player further opportunities of choice and which does not risk any reward obtained during the play of the primary game.

SUMMARY OF THE INVENTION

There is, therefore, set forth according to the present invention a method and device for playing a game offering a primary and secondary game. The method includes providing a primary game played by a player to obtain primary game outcomes. The first game may be a video poker game, a multiple reel slot machine, keno or the like. The method further includes the player making a wager to play the primary game to obtain an outcome. A triggering event is selected which occurs during play of the primary game. This triggering event may be one or more pre-determined outcomes obtained from the primary game, based upon the wagering history at the machine, based upon time or combination of the foregoing. Upon occurrence of the triggering event, e.g. the player obtaining a flush playing a primary game of video poker, a secondary game is provided offering a field of game choice symbols representing hidden values. In the preferred embodiment as hereinafter described, a matrix of symbols is presented, each representing hidden values which are the faces of playing cards. The player to play the secondary game selects a plurality of symbols from the field of game choices, the selection revealing the hidden values which define the secondary game outcome. The secondary game outcome is compared to pre-determined secondary game winning outcomes to determine if the player is entitled to an additional reward. If the player is indeed entitled to an additional reward, the reward from the secondary game is added to any reward obtained by the player for the primary game. Thereafter, the method includes returning to the player playing the primary game.

The device according to the present invention includes a display and data processor including a data structure storing data corresponding to at least one triggering event. As stated above, the triggering event may be an outcome obtained during play of a primary game, based upon the wagering history at the machine, time or the like. Means are provided at the device to receive a wager to play the primary game. Means are provided for sensing play of the primary game and for generating data signals in response thereto. For example, these means may sense outcomes. The processor for the device includes means to compare the data signals to data corresponding to the triggering event to determine if the triggering event has occurred. If the triggering event has occurred, such as where the player is playing a primary game of video poker and has obtained the pre-determined triggering event of a primary game outcome of a flush, the processor is adapted to issue signals to the display to display a plurality of secondary game choice symbols, the symbols representing hidden values. Means are provided for the player to select a plurality of symbols, the processor in response to the selection of symbols adapted to reveal at the display hidden values defining the secondary game outcome. The secondary game outcome is compared to data corresponding to at least one winning secondary game outcome represented by data stored in the processor data structure to determine if the secondary game is a winning outcome. Means are provided for rewarding the player if he has obtained a secondary game winning outcome whereupon the processor returns the player to the primary game.

As can be appreciated, the method and device according to the present invention does not require the player to risk any reward they may have obtained during play of the primary game, offers the player choice options in playing the secondary game and is presented in such the manner that large rewards can be provided.

BRIEF DESCRIPTION OF THE DRAWINGS

These and other features and advantages will become appreciated as the same becomes better understood with reference to the specification, claims and drawings wherein

DESCRIPTION

Figure 1:
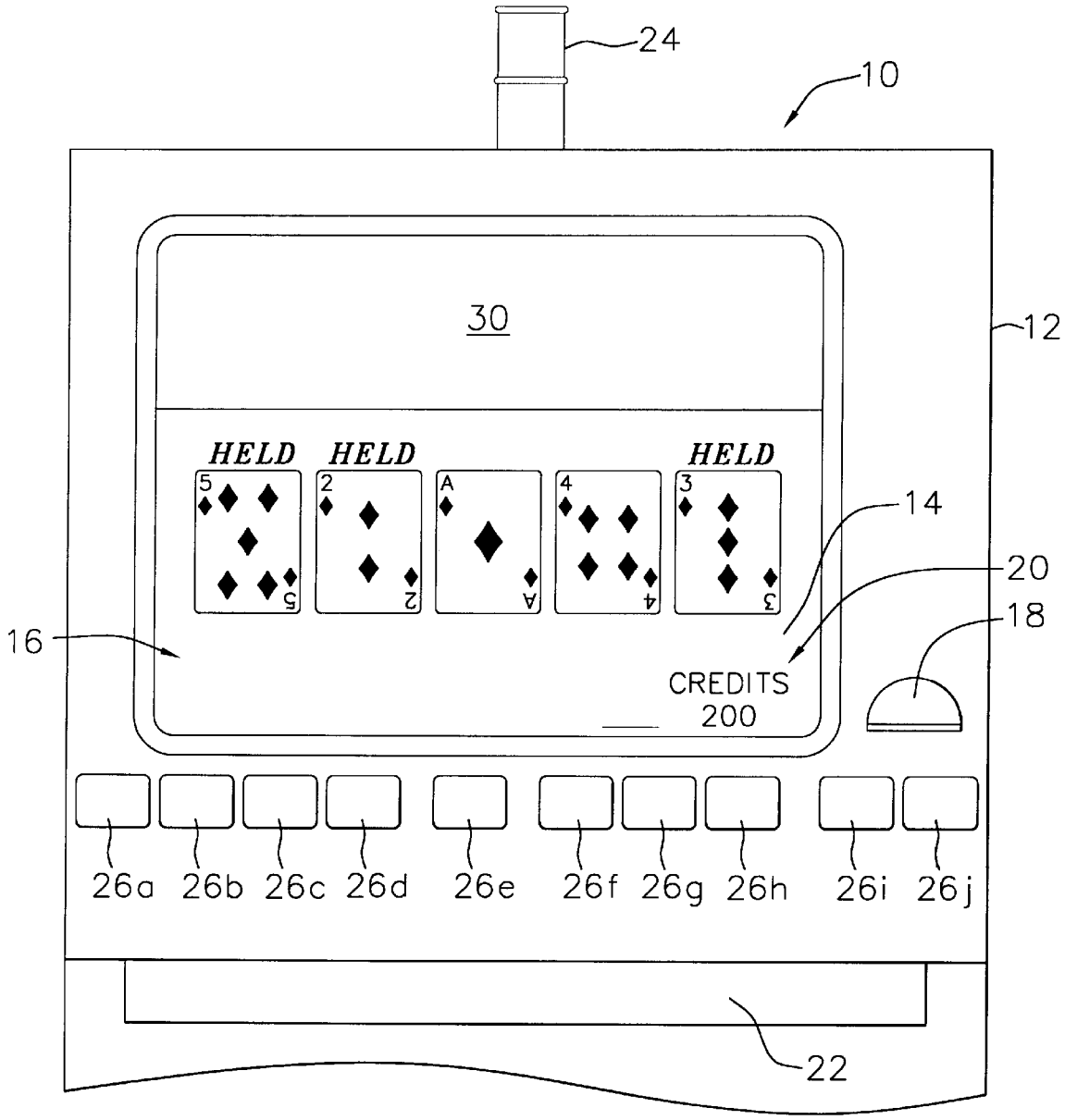
FIG. 1 illustrates one embodiment of a device for playing the game according to the present invention, showing a display of a primary game outcome.

Turning to the drawings, FIG. 1 shows a gaming device 10 according to the present invention and adapted to practice the method of the present invention. While the device 10 as illustrated in FIG. 1 and the description as hereinafter provided is directed to the device 10 offering a primary game of electronic video poker, it is to be understood that the device and method could be employed with other primary games such as video keno, electromechanical, multiple reel, slot machines, electronic slot machines and the like which are well known in the art. Further, while the primary game as hereinafter described is directed to a stud poker video game, it is to be understood that the device and method of the present invention could be employed with other types of video poker games such as deuces wild and Jokers/deuces wild. Still further, the device 10 and method according to the present invention could be used with other video games such as video Caribbean Stud™, video Let It Ride™. These primary games are well known in the art.

Figure 2:
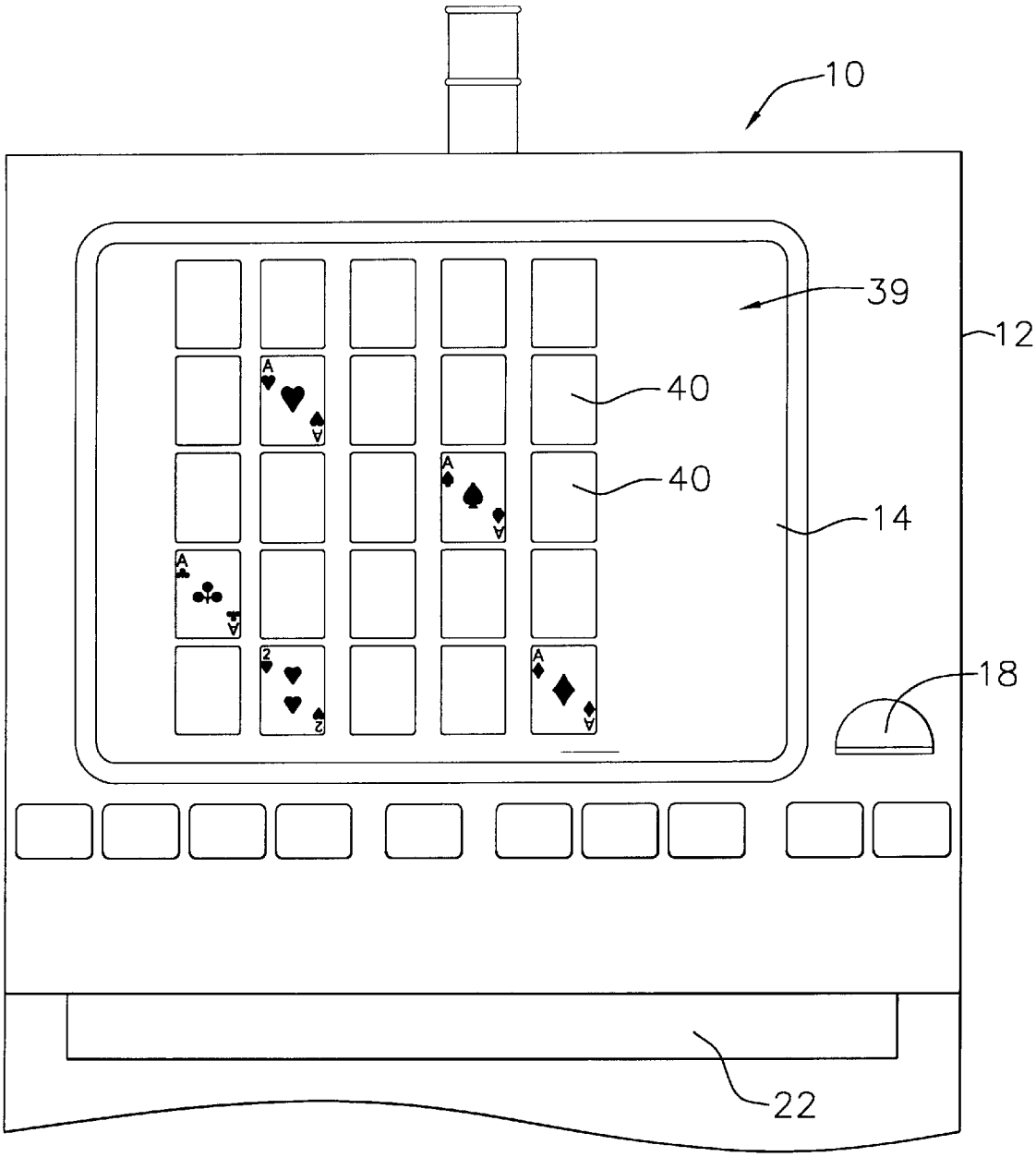
FIG. 2 illustrates a device according to the present invention illustrating a display of an outcome for a secondary game.

The device 10 has a housing 12 of conventional design. The housing 12 mounts, as shown in FIGS. 1 and 2, a video display 14 also of conventional construction. Where the device 10 is an electromechanical multiple reel slot machine, the display 14 would provide a view of the rotating reels of the slot machine in a known manner. Disposed within the housing 12 is a processor (not shown) likewise of known design. The processor, as is well known with conventional electronic gaming devices, controls the operation of the device and presentation at the display 14.

Preferably the video display 14 has provided therewith a touch screen device 16 of known construction whereby the player, by touching a location on the device 16 which overlays the display 14 can input data to the processor.

To receive wagers, the device 10 includes a coin slot 18 through which coins or token are inserted into the device 10 to play the game. In a known fashion, when a coin or token is inserted into the coin slot 18 the authenticity of the coin is tested, the coin is received and dropped into a hopper or other collection container and the coin receiving mechanism issues a data signal to the processor indicating receipt of the wager. Alternatively, the device 10 may have associated therewith a cash receiving device (not shown) of known construction whereby a player can insert paper currency which is read and authenticated and which, in response to authentication transmits a data signal to the processor in response thereto. For example, if the device 10 is a 25¢ machine, a player by inserting a $20 dollar bill into the cash reader would result in issuance of a data signal to the processor to register 80 credits available for wagering at the device 10. As shown in FIG. 1, the credits available for wagering and accumulated during play of the game or upon inputting wagers or cash denominations are shown at credit location 20.

Continuing with FIG. 1, the device 10 has a coin tray 22 to receive coins or tokens dispensed by the device 10 to the player. Also the device 10 has a candle 24 which provides lights for the machine by which the player may signal an attendant in to which is lit by the processor in the event of a malfunction, jackpot or the like.

In a known configuration, the device 10 further includes a plurality of operation buttons 26*a–j*. By these buttons the player may control the play of the game, wagers, and the like. With continuing reference to FIG. 1, button 26*a* if depressed, lights candle 24 to signal the attendant that, for example, the player needs change or that the machine has malfunctioned. Button 26*b* represents a cashout button which, if depressed by the player, causes the device 10 to dispense all winnings accumulated as credits into the coin tray 24. Button 26*c*, if depressed by the player, controls the processor to wager, each time button 26*c* is depressed, one credit. Buttons 26*b–h* are used, in a manner described below, to control the play of the primary game shown, in FIG. 1, as video poker. The aforesaid buttons 26*d–h* enable the player to hold and discard cards in a well known fashion. Button 26*i* enables the player, upon depressing button 26*i*, to wager the maximum amount of credits permitted at the device 10. Presently, most devices 10 of the type illustrated in FIG. 1 enable the player to make a maximum wager of five credits. Accordingly, by depressing button 26*i*, the processor would be controlled to deduct five credits from the accumulated credits shown at credit location 20 and to initiate play of the primary game. Finally, button 26*j* is a deal/draw button. If less than the maximum amount permitted at the device is wagered, the player depresses the deal/draw button 26*j* to initiate play of the game. Furthermore, deal/draw button 26*j* is also depressed to, after the player has discarded or held the cards desired, complete the play of the hand and obtain an outcome for the primary game.

With the foregoing described, play of a primary game of video poker available according to one embodiment of the present invention will now be described.

The player first makes a wager for the primary game. This is done by inserting coins or tokens at coin slot 18 or by wagering accumulated credits by depressing single wager button 26*c* or maximum wager button 26*i*. In the preferred embodiment of the present invention, for a player to be entitled to participate in the secondary game hereinafter described, the player must make a maximum wager. Assuming that the player has made the maximum wager by depressing button 26*i*, the processor initiates play of the game by randomly selecting from data stored in a suitable data structure data representing five playing cards. The processor drives the display 14 to display representations of the five playing cards representing an initial holding for a poker hand. From this initial holding as displayed at display 14, the player must decide which of the cards to hold and which to discard. The player makes the selection by depressing the button 26*d–h* corresponding with the cards to be held. As shown in FIG. 1, from the initial holding, the player depressed buttons 26*d*, 26*e* and 26*h* to hold the five of diamonds, two of diamonds and three of diamonds. After the player has made the selection of the cards to be held, he/she depress the deal/draw button 26*j* which replaces the discarded cards with replacement cards as randomly selected from the data structure. As shown in FIG. 1, the replacement cards are the Ace of diamonds and four of diamonds. Once the replacement cards have been displayed, the final hand is shown and represents the outcome of the primary game of video poker. When the primary game outcome has been obtained, the processor compares the data corresponding the poker hand outcome with data stored in a data structure to determine if the primary game outcome corresponds to a pre-determined primary game winning outcome. If the primary game outcome, shown here as a straight flush in diamonds, is a winning outcome, the player receives a reward based upon a predetermined pay table 30 which may be displayed at display 14. Below in Table 1 are some exemplary primary game winning outcomes and payoffs for stud, video poker.

TABLE 1

| OUTCOME | PAYOFF |
|---|---|
| Pair of Jacks or Better | 1:1 |
| Two Pair | 1:1 |
| Three-of-a-Kind | 3:1 |
| Straight | 5:1 |
| Flush | 6:1 |
| Full House | 9:1 |
| Four-of-a-Kind (5's–Kings) | 50:1 |
| Four-of-a-Kind (2's–4's) | 80:1 |
| Four-of-a-Kind (Aces) | 160:1 |
| Straight Flush | 50:1 |
| Royal Flush (with maximum coins) | 4,000 coins/tokens |

It is to be understood that other pay tables could be adopted for payoffs. Further, for different games such as deuces wild and Joker's wild, different pay tables are established.

If the primary game outcome corresponds to a pay table winning outcome, the player is rewarded according to the pay table 30. If the outcome does not correspond to a pay table winning outcome, the wager is lost. Once the outcome has been resolved, the player re-initiates play of the primary game, here video poker, to obtain additional outcomes.

As is well known, many players simply play a primary game of video poker, or the derivations thereof, for fun and excitement. Their only chance of obtaining a reward is to obtain a corresponding, winning outcome. For the greatest payoff, the player must obtain a royal flush. Some establishments have offered greater payoffs if the royal flush is in sequence, e.g. A K Q J 10.

Furthermore, as discussed above, the primary game may be one of either electronic or electromechanical slot machines, electronic keno or other games provided in either electronic or electromechanical format. Suffice it to say, during the play of each of these primary games, the player makes a wager, initiates play and obtains a primary game outcome, which may be a winning outcome or a losing outcome.

To increase the excitement of play, the device 10 and method according to the present invention provides a secondary game. According to the method of the present invention, the player playing the secondary game does not risk any rewards that he/she may have received in the primary game, gives the player choices and can offer large rewards.

Figure 4:
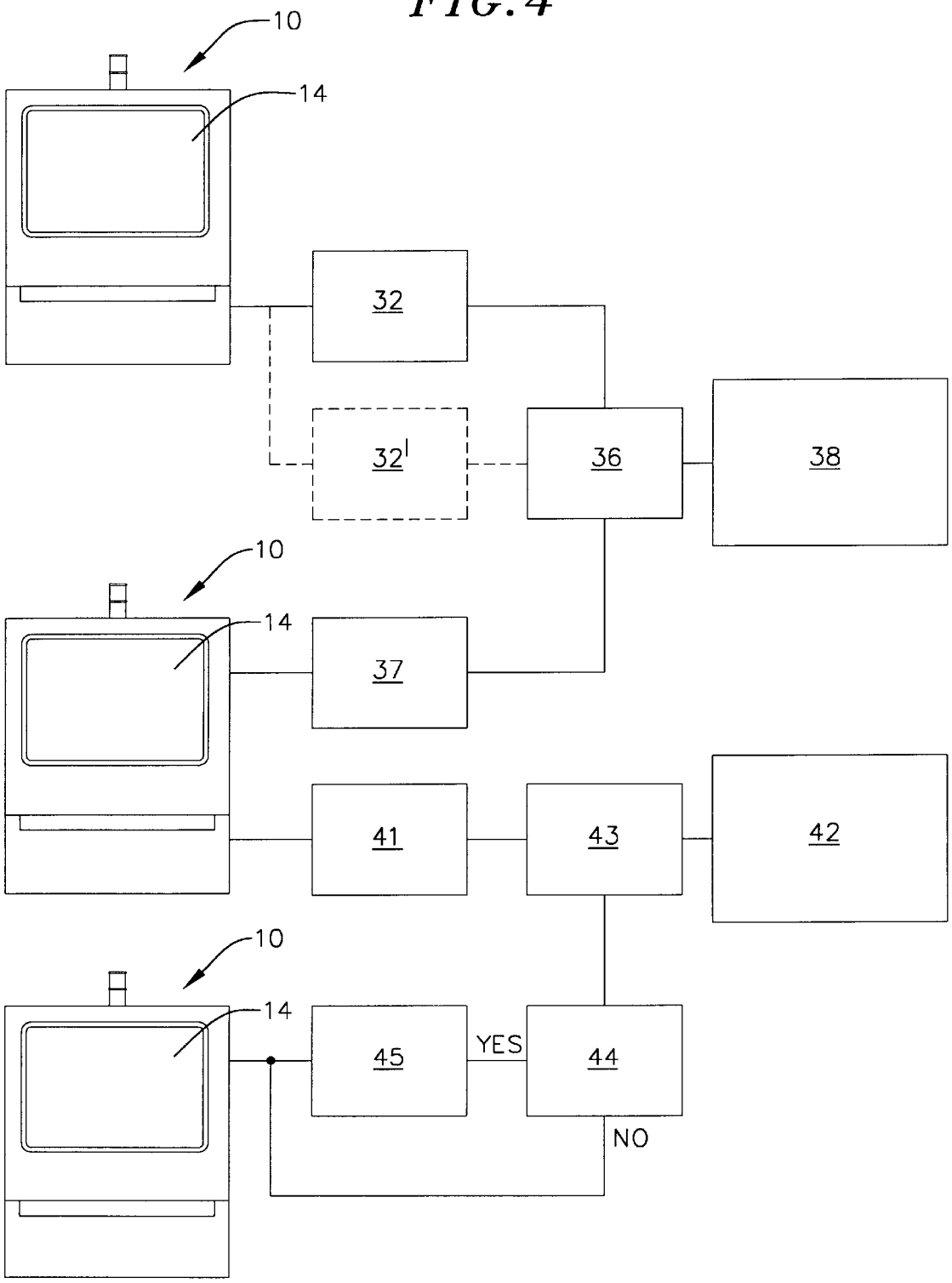
FIG. 4 illustrates a flow chart for yet a further embodiment of the method according to the present invention.

To participate in the secondary game, one or more triggering events are selected which, if sensed during play of the primary game, initiate play of the secondary game. With reference to FIGS. 1 and 4, the selected triggering events 32 may be the player obtaining one or more predetermined outcomes of the primary game or may be as at 32' based upon the historical wagering record of wagers made at the device 10. With reference to FIG. 1 and FIG. 4, it is seen that the player during play of the primary game has obtained a straight flush in diamonds. According to the preferred embodiment, the triggering event is the player obtaining any primary game outcome of a flush. Accordingly, since the player has obtained a flush during play of the primary game not only does the player receive the reward therefor but also the secondary game is triggered.

Triggering of the secondary game results in the processor issuing commands to display at the display 14 a plurality or field of second game choices 34. It is to be understood that where the triggering event is based upon a primary game outcome, that triggering event can be selected as one or more outcomes such as obtaining a flush or better or four-of-a-kind during play of the video game, certain payoffs obtained during play of the video keno game or the arrangement of certain symbols during play of a electronic or electromechanical multiple reel slot machine.

Additionally or alternatively, the triggering event 32' may be selected as an "Nth coin" event. As stated above, the processor is adapted to keep track of the wagers made during play of the primary game. The processor may be configured to accrue data representing the amount wagered until a predetermined, accrued amount is reached. Thereafter the next, or Nth, coin or wager made at the device 10 will constitute the triggering event to initiate play of the secondary game. If the game requires a maximum wager to participate in the secondary game, the Nth coin would be the next maximum wager.

Alternatively, the triggering of the secondary game may be based upon time. For example, from the last play of the secondary game, the processor may maintain by internal clock means, a chronological record until a pre-determined time is reached. When that time is reached, regardless of the outcome obtained during play of the primary game, the secondary game will be triggered for play by the player.

Alternatively, any combination of primary game outcome, Nth coin or time may be used as a triggering event. For example, if a time parameter is selected but an Nth coin is wagered before the selected time, the secondary game would be initiated.

Other parameters could be selected for triggering the second game. For example, some casinos have player tracking systems which track the player's wagering history at the gaming machines. Typically the player is issued an identification card which they insert into a card reader at their machine and signals are sent to a host processor which maintains an account for that player and, by various means, tracks the amount wagered by the player over time. Typically these systems are used to provide cash or other awards to players depending upon the player's account of wagering history. According to this embodiment, a triggering event may be selected by the player's account reaching a certain level.

As can be understood, any one or combination of triggering events can be selected.

Returning to the drawings, in the preferred embodiment, the triggering event is selected by the player obtaining a flush during play of the primary game of video poker. As shown in FIG. 4, when a triggering event 32 has occurred, the processor is controlled to select at 36 from a stored set of values 38 for play of the secondary game hidden values. The processor also, as shown in FIG. 2, controls the display 14 to display at 37 a plurality or field 39 of second game choice symbols 40 at the display 14. As shown in FIG. 2, the symbols 40 may be backs of playing cards, stars, squares, logos or other symbols. According to the secondary game, the symbols 40 represent the selected hidden values.

The player to play the secondary game, by using the touch screen device 16, selects at 41 a plurality of symbols from the displayed field 39 of symbols 40. According to the embodiment shown in FIG. 2, the secondary game requires the player to select five symbols 40 in an attempt to assemble a winning poker hand. The player simply touches the touch screen device 16 over the display 14 where the chosen selection resides. As the player selects the symbols, the hidden values as selected at select 36 are displayed. When all required symbols 40 have been selected, the revealed values represent the outcome for the secondary game.

When the outcome of the secondary game has been determined, the secondary game outcome is compared at 43 to a processor data structure storing data representing secondary game winning outcomes 42 to determine if the player has obtained indeed a winning outcome. Winning outcomes for the secondary game, which is based upon assembling of poker hands, may be according to Table 2.

TABLE 2

| WINNING OUTCOME | REWARD (COINS/TOKENS |
|---|---|
| Pair of Jacks or Better | 5 units |
| Two Pair | 10 units |
| Three-of-A-Kind | 15 units |
| Straight | 20 units |
| Flush | 25 units |
| Full House | 100 units |
| Four-of-A-Kind | 1,000 units |
| Straight Flush | 10,000 units |
| Royal Flush | 1,000,000 units |

If the player has obtained a secondary game winning outcome as compared at 43, the reward at 44 is issued and paid out at 45 to the player either by the device 10 dispensing coins into the coin tray 22 or by accumulating credits at credit location 20. If the secondary game winning outcome is not a winning outcome, no reward is issued. Thereafter the method and system returns the player to play the primary game to obtain the next outcome.

If the secondary game results in the issuance of a reward to the player, that reward is issued in addition to any reward the player received during play of the primary game. For example, according to the example shown in FIGS. 1 and 2, the player would receive a reward of, for a maximum wager of five coins, 250 coins for obtaining a straight flush and an additional 1,000 coins for obtaining four-of-a-kind, four Aces. Accordingly, the player would receive a total reward of 1,250 coins.

As can be appreciated, the player, by participating in the secondary game, does not risk the reward that they obtain from playing the primary game. Furthermore, the secondary game provides the player with choice options. This contributes to the excitement of the game. Furthermore, by providing this secondary game according to the present invention, large rewards can be offered which, as shown in Table 2, can amount to a million coins.

Figure 3:
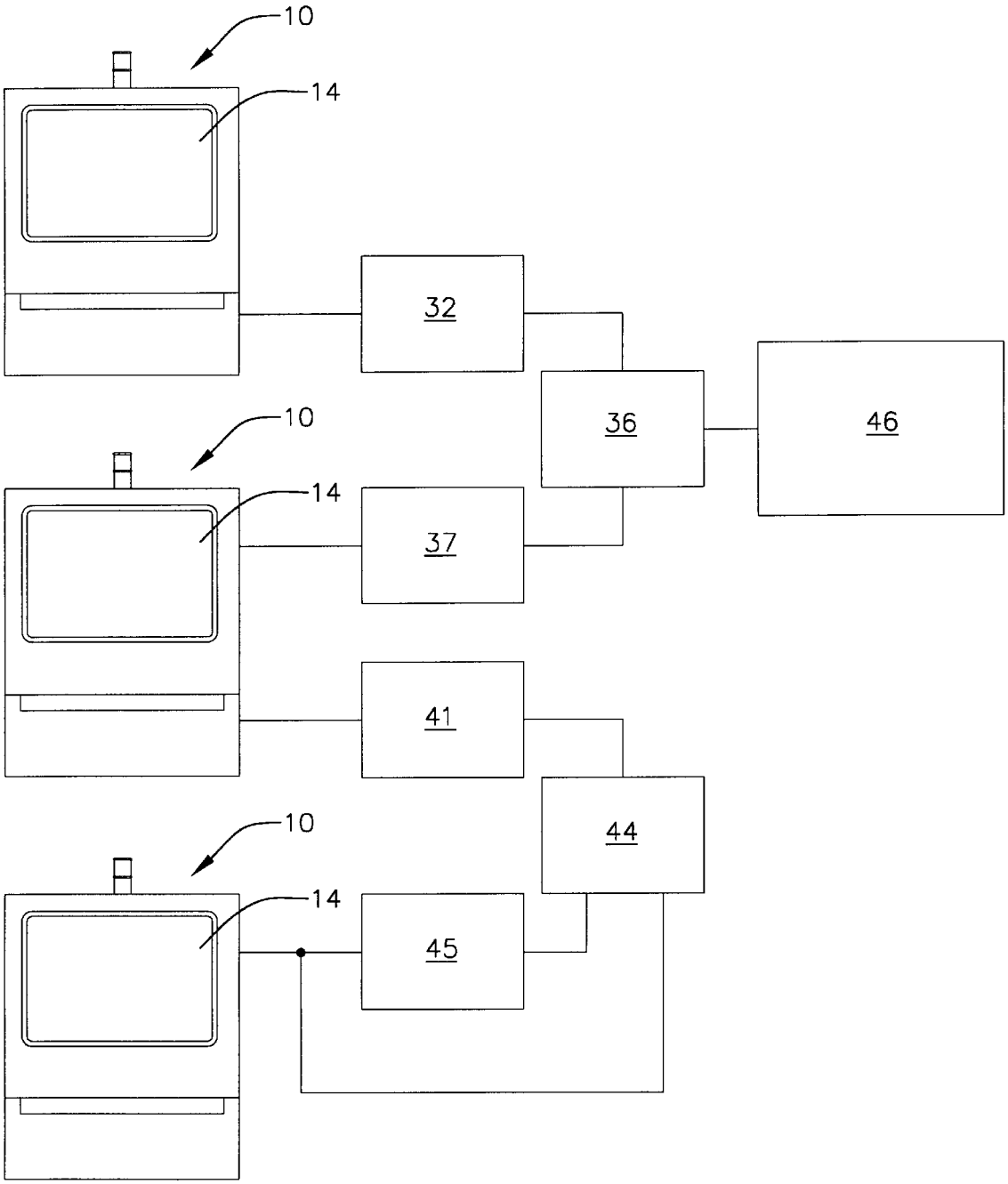
FIG. 3 illustrates a flow chart according to one embodiment of the method of the present invention.

With reference to FIG. 3, a further embodiment of the present invention as shown. Like components bear like reference numbers.

According to this embodiment, when the triggering event 32 occurs, the processor is adapted at select 36 to select the outcome which will be obtained during play of the secondary game. According to this embodiment, the data structure stores data representing hidden values of probability weighted outcomes at 46. For example, the secondary outcome may be pre-selected 46 such that the player obtaining a pair of jacks or better will occur 30% of the time, 3 of a kind 15% of the time, with a royal flush occurring less than 1% of the time. The processor is then adapted at select 36 to randomly select from these weighted probabilities the ultimate outcome for the secondary game. Thus, during play of the secondary game, the player may be assured of obtaining a winning outcome, however the probabilities are more likely that the winning outcome will be a pair of jacks or three-of-a-kind or the like. Once the selection is made, at display 37, the secondary field of choice symbols is displayed, as suggested in FIG. 2, enabling the player to make choices. The player then touches the displayed symbols 40 which in turn prompt the processor to reveal the pre-selected values based upon the random selection form the probability weighted values. The weighted probability set of values 38 may include losing outcomes as well. If the player has obtained a winning outcome, at 44, their reward is added to any reward that was obtained during play of the primary game.

While I have shown and described certain embodiments of the present invention it is to be understood that it is subject to many modifications without departing from the spirit and scope of the claims set forth herein. For example, as described above, the primary game may be any heretofore known or to be developed primary game by which a player makes a wager and obtains a primary game outcome. Furthermore, while FIG. 2 shows that the field of game choice symbols 40 is a 5×5 matrix, any suitable number of game choice symbols or arrangement can be used. For example, the secondary game may be presented as a pictorial display such as a house by which the player selects locations in the house which reveal hidden values. Alternatively, the pictorial display could be an automobile offering the player the choice symbols of selecting locations on the automobile.

Further, the selected hidden values need not be faces of playing cards. They may be numbers which must be matched or add-up to a certain number or graphical representations which must conform to the one or more predetermined secondary game winning outcomes.

Still further, in play of the secondary game, one or more values may be initially displayed with the player having to select a plurality to complete the outcome. For example, when the secondary game is initially displayed upon the occurrence of the selected triggering event, the display may show three cards to a royal flush requiring the player to make two selections to try to complete the hand.

I claim:

1. A method for playing a game comprising:

providing a primary game played by a player to obtain primary game outcomes;

the player making a wager to play the primary game to obtain each primary game outcome;

tabulating an amount based upon the amount wagered by the player while playing the primary game over time and selecting a triggering event as the tabulated amount reaching a selected amount;

upon occurrence of the triggering event, providing a secondary game, said secondary game offering a field of game choice symbols representing hidden values;

the player selecting a plurality symbols from the field, said selection revealing a hidden value, said revealed values defining a secondary game outcome;

comparing the secondary game outcome to a predetermined secondary game winning outcome; and if the secondary game outcome corresponds to the predetermined secondary game winning outcome, rewarding the player.

2. A gaming device comprising:

a display;

a data processor including a data structure storing data corresponding to at least one triggering event;

means for receiving a wager to play a primary game;

means for tabulating at least a portion of the amount wagered and issuing data signals corresponding thereto, said data structure including data representing the triggering event as achieving a selected tabulated amount, said processor including means to compare the tabulation data signals to the tabulated amount data to determine if said triggering event has occurred;

means for displaying at the display the outcomes of play of the primary game;

means for sensing the play of the primary game and generating data signals in response thereto;

said processor including means to compare said data signals to the data corresponding to the triggering event to determine if the triggering event has occurred;

if said triggering event has occurred, said processor adapted to issue signals to display at the display a plurality of secondary game choice symbols, each symbol representing a hidden value;

means for the player to select a plurality of said symbols, said processor in response to selection of said symbols adapted to reveal at the display the hidden values represented by said selected symbols, said revealed values defining a secondary game outcome;

said data structure including data corresponding to at least one winning secondary game outcome;

means to compare the secondary game outcome to said winning secondary game outcome to determine if the secondary game winning outcome has been obtained;

means for rewarding the player if he has obtained said secondary game winning outcome.

* * * * *